US006986253B2

(12) United States Patent
Leen et al.

(10) Patent No.: US 6,986,253 B2
(45) Date of Patent: Jan. 17, 2006

(54) METHODS AND APPARATUS FOR COOLING GAS TURBINE ENGINE COMBUSTORS

(75) Inventors: Thomas A. Leen, Cincinnati, OH (US); Steve Steffens, Cincinnati, OH (US); Craig Douglas Young, Maineville, OH (US)

(73) Assignee: General Electric Company, Schenectady, NY (US)

( * ) Notice: Subject to any disclaimer, the term of this patent is extended or adjusted under 35 U.S.C. 154(b) by 173 days.

(21) Appl. No.: 10/620,926

(22) Filed: Jul. 16, 2003

(65) Prior Publication Data

US 2005/0011196 A1 Jan. 20, 2005

(51) Int. Cl.
*F23R 3/02* (2006.01)

(52) U.S. Cl. ..... 60/772; 60/752

(58) Field of Classification Search ..... 60/748, 60/752, 756, 757, 772
See application file for complete search history.

(56) References Cited

U.S. PATENT DOCUMENTS

| | | | | |
|---|---|---|---|---|
| 4,916,905 | A | 4/1990 | Havercroft et al. | |
| 5,396,759 | A | 3/1995 | Richardson | |
| 5,419,115 | A | 5/1995 | Butler et al. | |
| 5,623,827 | A * | 4/1997 | Monty | 60/748 |
| 5,630,319 | A | 5/1997 | Schilling et al. | |
| 5,924,288 | A | 7/1999 | Fortuna et al. | |
| 6,279,323 | B1 * | 8/2001 | Monty et al. | 60/752 |
| 6,581,386 | B2 * | 6/2003 | Young et al. | 60/748 |

* cited by examiner

*Primary Examiner*—Louis J. Casaregola
(74) *Attorney, Agent, or Firm*—William Scott Andes; Armstrong Teasdale LLP

(57) ABSTRACT

A method facilitates the operation of a gas turbine engine that includes a combustor including a combustion chamber. The method comprises supplying fuel to the combustion chamber, and directing compressed airflow through a combustor dome assembly that includes a splashplate and a unitarily formed flare cone, such that at least a portion of the compressed airflow is channeled axially downstream through at least one cooling passage defined between the flare cone and the splashplate for cooling of the dome assembly.

20 Claims, 3 Drawing Sheets

METHODS AND APPARATUS FOR COOLING GAS TURBINE ENGINE COMBUSTORS

BACKGROUND OF THE INVENTION

This application relates generally to gas turbine engines and, more particularly, to combustors for gas turbine engine.

Combustors are used to ignite fuel and air mixtures in gas turbine engines. Known combustors include at least one dome attached to a combustor liner that defines a combustion zone. Fuel injectors are attached to the combustor in flow communication with the dome and supply fuel to the combustion zone. Fuel enters the combustor through a dome assembly attached to a spectacle or dome plate.

The dome assembly includes an air swirler secured to the dome plate, and radially inward from a flare cone. The flare cone is divergent and extends radially outward from the air swirler to facilitate mixing the air and fuel, and spreading the mixture radially outwardly into the combustion zone. A divergent splashplate extends circumferentially around the flare cone and radially outward from the flare cone. The splashplate prevents hot combustion gases produced within the combustion zone from impinging upon the dome plate.

To facilitate reducing temperatures of the splashplate, at least some known combustor dome assemblies supply cooling air for convection cooling of the dome assembly through a gap extending partially circumferentially between the flare cone and the splashplate. Such dome assemblies are complex, multi-piece assemblies that require multiple brazing operations to fabricate and assemble. In addition, during use the cooling air may mix with the combustion gases and adversely effect combustor emissions.

Because multi-piece combustor dome assemblies are also complex to disassemble for maintenance purposes, at least some other known combustor dome assemblies include one-piece assemblies. However, such assemblies still require pre-assembly welding and as such, may adversely impact splashplate and flare cone durability.

BRIEF SUMMARY OF THE INVENTION

In one aspect, a method for operating a gas turbine engine including a combustion chamber is provided. The method comprises supplying fuel to the combustion chamber, and directing compressed airflow through a combustor dome assembly that includes a splashplate and a unitarily formed flare cone, such that at least a portion of the compressed airflow is channeled through at least one cooling passage defined between the flare cone and the splashplate for cooling of the splashplate.

In another aspect, a combustor for a gas turbine engine is provided. The combustor comprises a dome assembly including a unitary body that includes a splashplate, a flare cone, and at least one cooling passage defined therebetween for discharging cooling air for cooling the splashplate.

In a further aspect, a gas turbine engine is provided. The gas turbine engine comprises a combustor that includes an annular dome assembly. The combustor includes an air swirler and a unitary body that extends circumferentially around the air swirler. The unitary body includes a splashplate, a flare cone, and at least one cooling passage that extends therebetween. The at least one cooling passage is for discharging cooling air therefrom for cooling the splashplate.

DETAILED DESCRIPTION OF THE INVENTION

Figure 1:
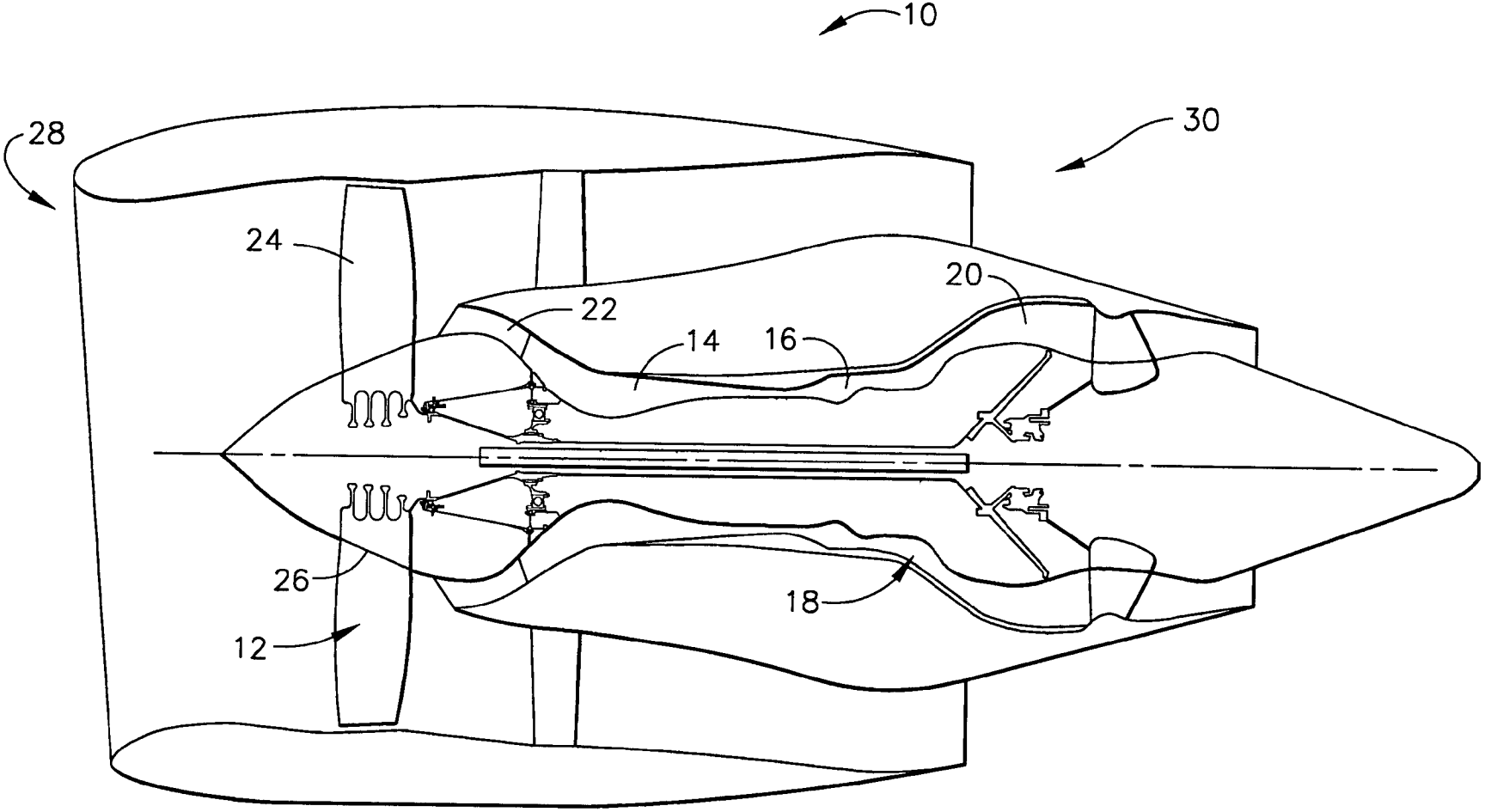
FIG. 1 is a schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, gas turbine engine 10 is a CF6-80 engine commercially available from General Electric Company, Cincinnati, Ohio.

In operation, air flows through fan assembly 12 and compressed air is supplied to high pressure compressor 14. The highly compressed air is delivered to combustor 16. Airflow from combustor 16 drives turbines 18 and 20, and turbine 20 drives fan assembly 12.

Figure 2:
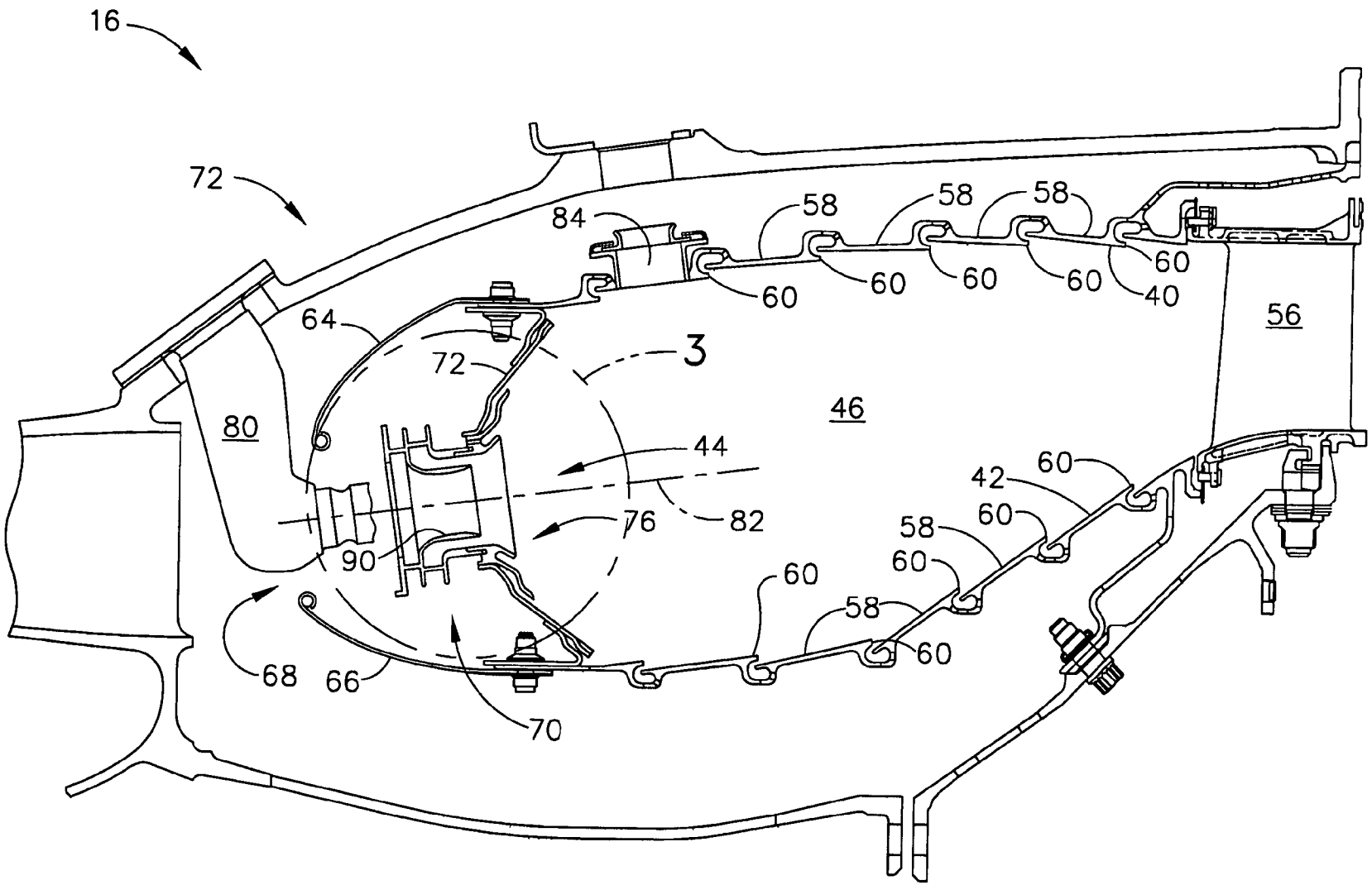
FIG. 2 is a cross-sectional view of a combustor used with the gas turbine engine shown in FIG. 1.
Figure 3:
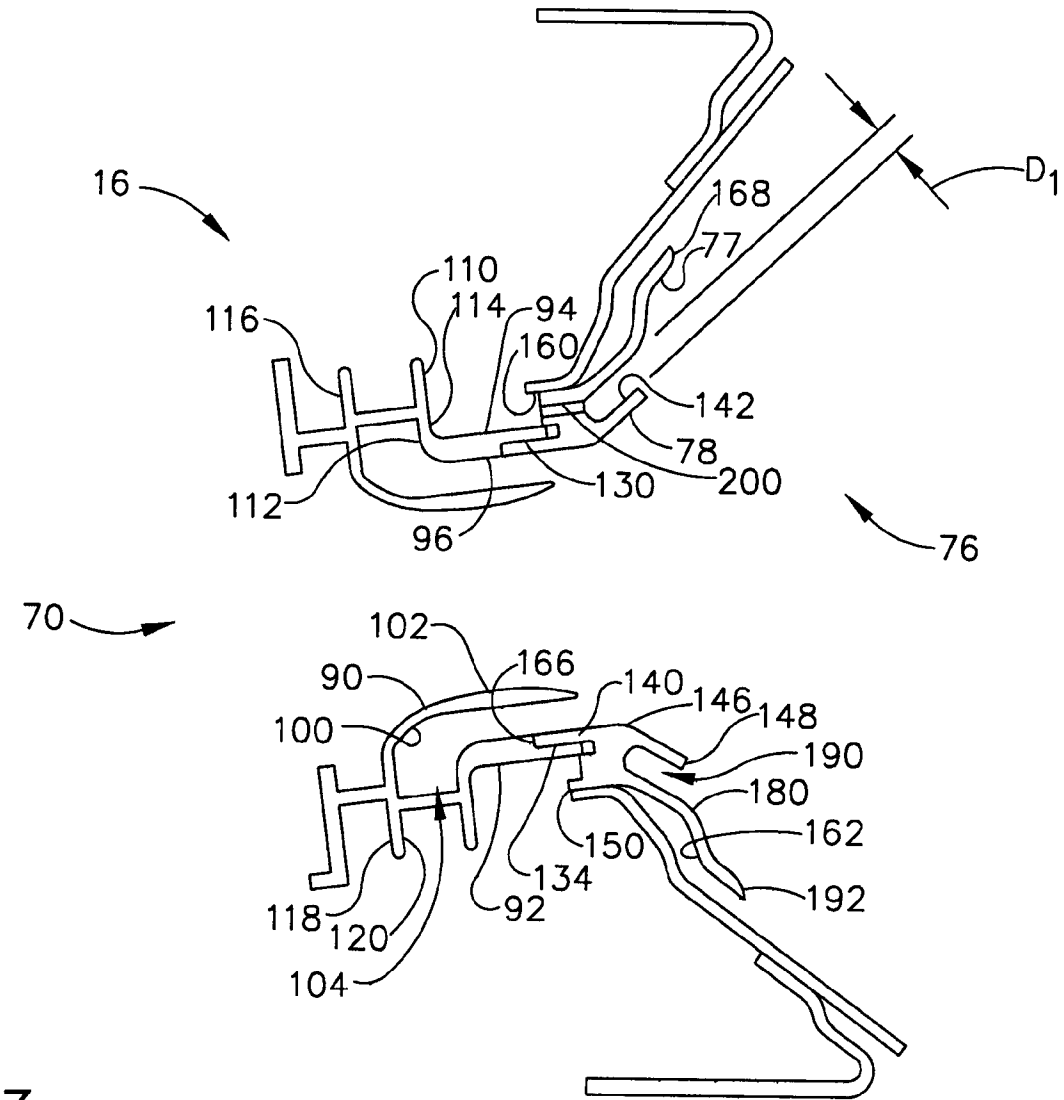
FIG. 3 is an enlarged view of a portion of the combustor shown in FIG. 2 and taken along area 3.

FIG. 2 is a cross-sectional view of combustor 16 used in gas turbine engine 10 (shown in FIG. 1). FIG. 3 is an enlarged view of a portion of combustor 16 taken along area 3 (shown in FIG. 2). Combustor 16 includes an annular outer liner 40, an annular inner liner 42, and a domed end 44 that extends between outer and inner liners 40 and 42, respectively. Outer liner 40 and inner liner 42 define a combustion chamber 46.

Combustion chamber 46 is generally annular in shape and is disposed between liners 40 and 42. Outer and inner liners 40 and 42 extend to a turbine nozzle 56 disposed downstream from combustor domed end 44. In the exemplary embodiment, outer and inner liners 40 and 42 each include a plurality of panels 58 which include a series of steps 60, each of which forms a distinct portion of combustor liners 40 and 42.

In the exemplary embodiment, combustor domed end 44 includes an annular dome assembly 70 arranged in a single annular configuration. In another embodiment, combustor domed end 44 includes a dome assembly 70 arranged in a double annular configuration. In a further embodiment, combustor domed end 44 includes a dome assembly 70 arranged in a triple annular configuration. Combustor dome assembly 70 provides structural support to an upstream end 72 of combustor 16, and dome assembly 70 includes a dome plate or spectacle plate 74 and a splashplate-flare cone assembly 76. Splashplate-flare cone assembly 76 is unitary and includes a splashplate portion 77 and a flare cone portion 78. In the exemplary embodiment, splashplate-flare cone assembly is fabricated using a casting process.

Combustor 16 is supplied fuel via a fuel injector 80 connected to a fuel source (not shown) and extending through combustor domed end 44. More specifically, fuel injector 80 extends through dome assembly 70 and discharges fuel in a direction (not shown) that is substantially concentric with respect to a combustor center longitudinal axis of symmetry 82. Combustor 16 also includes a fuel igniter 84 that extends into combustor 16 downstream from fuel injector 80.

Combustor 16 also includes an annular air swirler 90 having an annular exit 92 that extends substantially symmetrically about center longitudinal axis of symmetry 82. Exit 92 includes a radially outer surface 94 and a radially inwardly facing flow surface 96. Annular air swirler 90 includes a radially outer surface 100 and a radially inwardly facing flow surface 102. Exit flow surface 96 and air swirler flow surface 102 define an aft venturi channel or annulus 104 used for channeling a portion of air downstream therethrough.

Exit 92 includes an integrally formed outwardly extending radial flange portion 110. Exit flange portion 110 includes an upstream surface 112 that extends from exit flow surface 96, and a substantially parallel downstream surface 114 that is generally perpendicular to exit flow surface 96. An integrally-formed radial flange portion 116 extends from air swirler 90. Flange portion 116 includes an upstream surface 118, and a downstream surface 120 that is substantially parallel to upstream surface 118 and extends from air swirler flow surface 102. Air swirler flange surfaces 118 and 120 are substantially parallel to exit flange surfaces 112 and 114, and are substantially perpendicular to air swirler flow surface 102.

Exit 92 includes an integrally-formed coupling joint 130 that defines an attachment slot 134. Splashplate-flare cone assembly 76 couples to exit 92 using coupling joint 130 and extends downstream from attachment slot 134. More specifically, flare cone portion 78 includes a radially inner flow surface 140 and a radially outer surface 142. When splashplate-flare cone assembly 76 is coupled to exit 92, flare cone radially inner flow surface 140 is substantially co-planar with exit flow surface 96. More specifically, flare cone inner flow surface 140 is divergent and extends downstream from coupling joint 130 to an elbow 146, before extending divergently outward from elbow 146 to a trailing end 148 of flare cone portion 78.

Flare cone outer surface 142 is substantially parallel to flare cone inner surface 140 between a leading edge 150 of flare cone portion 78 and elbow 146. Flare cone outer surface 142 is divergent and extends radially outwardly from elbow 140, such that in the exemplary embodiment, outer surface 142 is also substantially parallel to flare cone inner surface 140 between elbow 146 and flare cone trailing end 148.

Splashplate portion 77 facilitates preventing hot combustion gases produced within combustor 16 from impinging upon combustor dome plate 74, and includes a flange portion 160 and a divergent portion 162. Flange portion 160 extends axially upstream from divergent portion 162 to a leading edge 166, and is substantially parallel with combustor center longitudinal axis of symmetry 82, such that flange portion leading edge 166 is upstream from flare cone leading edge 150.

Splashplate divergent portion 162 extends radially outwardly and downstream from flange portion 160 to a trailing edge 168. More specifically, divergent portion 162 is oriented generally parallel to flare cone portion 78 between flare cone trailing end 148 and flare cone elbow 146, between flange portion 160 and a splashplate elbow 180. Divergent portion 162 extends divergently outward from elbow 180 to trailing edge 168.

Splashplate divergent portion 162 is spaced radially outwardly from flare cone portion 78 such that an annular gap 190 is defined therebetween. Specifically, gap 190 is defined between a radially inner surface 192 of divergent portion 162 and flare cone outer surface 142. Gap 190 has a diameter $D_1$ that facilitates improving the producablity of splashplate-flare cone assembly 76.

A plurality of circumferentially-spaced openings 200 are formed through splashplate-flare cone assembly 76. Specifically, openings 200 extend through substantially axially through assembly 76 in a direction that is substantially parallel to centerline axis 82, such that splashplate flange portion 160 is defined within assembly 76 by openings 200. Openings 200 discharge cooling air therethrough at a reduced pressure for cooling of splashplate-flare cone assembly 76. In one embodiment, the cooling air is compressor air. In the exemplary embodiment, openings 200 are formed using an electro-discharge machining (EDM) process.

During operation, cooling air is supplied to splashplate-flare cone assembly 76 through openings 200. Openings 200 facilitate providing a continuous flow of cooling air to be discharged at a reduced air pressure for impingement cooling of flare cone portion 78. The reduced air pressure facilitates improved cooling and backflow margin for the impingement cooling of flare cone portion 78. Furthermore, the cooling air enhances convective heat transfer and facilitates reducing an operating temperature of flare cone portion 78, which facilitates extending a useful life of flare cone portion 78, while reducing a rate of oxidation formation of flare cone portion 78.

Furthermore, as cooling air is discharged through openings 200, splashplate divergent portion 162 is film cooled. More specifically, openings 200 supply splashplate divergent portion inner surface 192 with film cooling. Because openings 200 are spaced circumferentially through splashplate-flare cone assembly 76, film cooling is directed along splashplate inner surface 192 substantially circumferentially around flare cone portion 78. In addition, because openings 200 facilitate substantially uniform cooling flow, splashplate-flare cone assembly 76 facilitates optimizing film cooling while reducing mixing of the cooling air with combustion air, which thereby facilitates reducing an adverse effect of flare cooling on combustor emissions.

The above-described combustor system for a gas turbine engine is cost-effective and reliable. The combustor system includes a unitary splashplate-flare cone assembly that includes a plurality of formed cooling openings extending therethrough. Cooling air supplied through the openings facilitates substantial circumferential impingement cooling of the flare cone portion of the splashplate-flare cone assembly, and film cooling of the splashplate portion of the splashplate-flare cone assembly. As a result, the splashplate-flare cone assembly facilitates extending a useful life of the combustor in a reliable and cost-effective manner.

Exemplary embodiments of combustor assemblies are described above in detail. The combustor assemblies are not limited to the specific embodiments described herein, but rather, components of each assembly may be utilized independently and separately from other components described herein. For example, each splashplate-flare cone assembly component can also be used in combination with other combustors.

While the invention has been described in terms of various specific embodiments, those skilled in the art will recognize that the invention can be practiced with modification within the spirit and scope of the claims.

What is claimed is:

1. A method for operating a gas turbine engine including a combustor, the combustor including a combustion chamber and a centerline, said method comprising:

supplying fuel to the combustion chamber; and directing compressed airflow through a unitary combustor dome assembly that includes a splashplate and a unitarily formed flare cone, such that at least a portion of the compressed airflow is channeled axially downstream and substantially parallel to the combustor centerline through at least one cooling passage that is formed between the flare cone and the splashplate for cooling of the dome assembly.

2. A method in accordance with claim 1 wherein directing compressed airflow through a combustor dome assembly further comprises directing airflow through the at least one cooling passage for impingement cooling the flare cone.

3. A method in accordance with claim 2 wherein directing airflow through at least one cooling passage further comprises channeling airflow from the at least one cooling passage into a gap defined between the splashplate and the flare cone, such that the airflow is discharged radially outward.

4. A method in accordance with claim 1 wherein directing airflow through at least one cooling passage further comprises directing airflow through a plurality of circumferentially-spaced cooling passages such that the flare cone is substantially circumferentially impingement cooled.

5. A method in accordance with claim 1 wherein said step of directing compressed airflow further comprises the step of reducing an operating temperature of the dome assembly flare cone to facilitate extending a useful life of the combustor.

6. A combustor for a gas turbine engine, said combustor comprising: a dome assembly comprising a unitary body comprising a splashplate, a centerline, a flare cone, and at least one cooling passage formed within said body between said flare cone and said splashplate for discharging cooling air in a direction that is substantially parallel to said combustor centerline for cooling at least a portion of said dome assembly.

7. A combustor in accordance with claim 6 wherein said at least one cooling passage is positioned to receive cooling air therein for impingement cooling at least a portion of said flare cone.

8. A combustor in accordance with claim 6 wherein said at least one cooling passage comprises a plurality of circumferentially-spaced cooling passages.

9. A combustor in accordance with claim 6 wherein said at least one cooling passage facilitates extending a useful life of said combustor.

10. A combustor in accordance with claim 6 wherein a gap is defined between said splashplate and said flare cone, said gap has a diameter that is larger than a diameter of said at least one cooling passage.

11. A combustor in accordance with claim 10 wherein the combustor has a centerline axis, said gap defined such that cooling air is discharged radially outwardly therefrom.

12. A combustor in accordance with claim 6 wherein said at least one cooling passage facilitates reducing a rate of oxidation formation within said dome assembly flare cone.

13. A gas turbine engine comprising a combustor comprising an annular dome assembly, said combustor dome assembly comprising an air swirler and a unitary body extending circumferentially around said air swirler, said unitary body comprising a splashplate, a flare cone, and at least one cooling passage formed therebetween, said at least one cooling passage for discharging cooling air therefrom in a direction that is substantially parallel a centerline of said dome assembly for cooling at least a portion of said combustor dome assembly.

14. A gas turbine engine in accordance with claim 13 wherein said at least one cooling passage positioned to discharge cooling air therefrom for impingement cooling of said flare cone.

15. A gas turbine engine in accordance with claim 14 wherein said at least one cooling passage comprises a plurality of cooling passages spaced circumferentially about said flare cone.

16. A gas turbine engine in accordance with claim 14 wherein said at least one cooling passage is formed using an electro-discharge machining process.

17. A gas turbine engine in accordance with claim 14 wherein at least a portion of said splashplate is spaced a radial distance from said flare cone such that a gap is defined therebetween, said gap comprises an entrance and an exit, said gap exit radially outward from said gap entrance.

18. A gas turbine engine in accordance with claim 17 wherein the combustor has a centerline axis, said gap positioned such that cooling air is discharged radially outwardly therefrom.

19. A gas turbine engine in accordance with claim 14 wherein said combustor dome assembly at least one cooling passage facilitates reducing a rate of oxidation formation within said combustor dome assembly.

20. A gas turbine engine in accordance with claim 14 wherein said combustor dome assembly at least one cooling passage facilitates extending a useful life of said combustor.

* * * * *